US009487274B2

(12) United States Patent
Hancock et al.

(10) Patent No.: US 9,487,274 B2
(45) Date of Patent: Nov. 8, 2016

(54) FLOATING DOCK

(71) Applicant: MARINE IP LIMITED, Lymington (GB)

(72) Inventors: Phillip Hancock, Lymington (GB); Christopher Wilson, Lymington (GB); Jamie Hooper, Lymington (GB)

(73) Assignee: MARINE IP LIMITED (GB)

( * ) Notice: Subject to any disclaimer, the term of this patent is extended or adjusted under 35 U.S.C. 154(b) by 0 days.

(21) Appl. No.: 14/655,249

(22) PCT Filed: Jan. 2, 2014

(86) PCT No.: PCT/GB2014/050003

§ 371 (c)(1),
(2) Date: Jun. 24, 2015

(87) PCT Pub. No.: WO2014/106743

PCT Pub. Date: Jul. 10, 2014

(65) Prior Publication Data

US 2015/0353174 A1 Dec. 10, 2015

(30) Foreign Application Priority Data

Jan. 3, 2013 (GB) ..... 1300075.7

(51) Int. Cl.

| | |
|---|---|
| ***B63C 1/04*** | (2006.01) |
| ***B63B 35/38*** | (2006.01) |
| ***B63C 1/02*** | (2006.01) |
| ***B63C 3/02*** | (2006.01) |
| ***B63C 3/08*** | (2006.01) |

(52) U.S. Cl.

CPC ..... *B63B 35/38* (2013.01); *B63C 1/02* (2013.01); *B63C 1/04* (2013.01); *B63C 3/02* (2013.01); *B63C 3/08* (2013.01)

(58) Field of Classification Search

CPC ..... B63C 1/02

See application file for complete search history.

(56) References Cited

U.S. PATENT DOCUMENTS

| | | | | |
|---|---|---|---|---|
| 4,779,887 | A * | 10/1988 | Briggs | B60P 3/1075 280/414.1 |
| 5,529,013 | A | 6/1996 | Eva, III et al. | |
| 5,641,242 | A | 6/1997 | Riviere | |
| 5,682,833 | A | 11/1997 | Eva, III et al. | |

(Continued)

FOREIGN PATENT DOCUMENTS

| | | |
|---|---|---|
| KR | 101 127 624 B1 | 3/2012 |
| WO | WO 2009/094671 A2 | 7/2009 |

OTHER PUBLICATIONS

PCT International Report on Patentability and Written Opinion of the International Searching Authority for International Application No. PCT/GB2014/050003, issued Jul. 7, 2015, 7 pgs.

(Continued)

*Primary Examiner* — Edwin Swinehart

(74) *Attorney, Agent, or Firm* — Patterson Thuente Pedersen, P.A.

(57) ABSTRACT

Floating dock suitable for docking sailboats comprising a floating deck area and two floating arms extending therefrom, the arms having interior edges adjacent an open area therebetween which, in use, is open to the water below, characterized in that the dock further comprises: a support bracket attachable to the interior edges of the arms and adapted to resist a force urging said arms apart; and an arrangement of rollers upstanding from the dock and adapted to support the underside of a boat guided thereon.

19 Claims, 8 Drawing Sheets

(56) References Cited

U.S. PATENT DOCUMENTS

| | | | | |
|---|---|---|---|---|
| 5,931,113 | A | 8/1999 | Eva, III et al. | |
| 5,947,050 | A | 9/1999 | Eva, III et al. | |
| 6,006,687 | A | 12/1999 | Hillman et al. | |
| 6,431,106 | B1 | 8/2002 | Eva, III et al. | |
| 6,602,022 | B1 * | 8/2003 | Wilkins | B63C 3/02 114/263 |
| 8,221,028 | B2 * | 7/2012 | Smith | B63C 1/02 114/263 |
| 2006/0263148 | A1 | 11/2006 | Way | |
| 2009/0194014 | A1 | 8/2009 | Kloster et al. | |
| 2010/0300345 | A1 * | 12/2010 | La Violette | B63B 3/08 114/263 |
| 2011/0243663 | A1 | 10/2011 | Smith | |

OTHER PUBLICATIONS

GB Examination Report for GB1300075.7, dated May 28, 2015, 3 pgs.
International Search Report for International Application No. PCT/GB2014/050003, mailed Apr. 22, 2014, 3 pgs.
Combined Search and Examination Report for GB1300075.7, dated May 1, 2013, 6 pgs.

* cited by examiner

FLOATING DOCK

RELATED APPLICATIONS

The present application is a National Stage entry of International Application No. PCT/GB2014/050003 filed Jan. 2, 2014, which claims the benefit of GB Application No. 1300075.7, filed Jan. 3, 2013, said applications being hereby incorporated by reference in their entirety.

This invention relates to floating docks, in particular those comprising multidirectional floating dock elements, and especially suited for docking sailboats.

BACKGROUND

Floating docks comprising multidirectional floating dock elements are well known. Floating docks can be constructed from subunit dock elements having projecting tabs at their edges for attachment to adjacent dock elements.

For example, U.S. Pat. Nos. 5,529,013, 5,682,833, 5,947,050, 6,431,106 and 5,931,113 teach a floating drive-on dock assembled using parallelepiped shaped units. The docks generally consist of two arms (single rows) of hollow and airtight floatation units. Between the arms is an area open to the water surface. At the distal end of the two arms, a floatation unit connects the arms together to prevent the arms from spreading apart as a craft is driven onto the arms.

The open centre of the above type of drive-on dock does not provide sufficient guiding for several types of boat hulls. In particular, the drive-on dock is unsuitable for sailboats which cannot be driven onto the dock. Furthermore, sailboats have a depending keel which either interferes with passage onto a dock of this type, or causes the two arms to spread apart undesirably. In either case, damage to the underside of the hull and/or keel may occur.

Consequently, sailboats are not docked on drive-on docks. Either they are hoisted vertically clear of the water using a hydraulic lift, examples of which are provided at http://www.boatlift.com. Alternatively, they may be winched out of the water onto a road trailer, examples of which are provided at http:/www.sbstrailers.com/. The latter requires sufficient waterside access for both the trailer and towing vehicle, which may not be convenient or even possible.

It is an object of the invention to provide a floating dock suitable for docking sailboats, which improves upon the known systems described above.

BRIEF SUMMARY OF THE DISCLOSURE

In accordance with the present invention there is provided a floating dock suitable for docking sailboats comprising a floating deck area and two floating arms extending therefrom, the arms having interior edges adjacent an open area therebetween which, in use, is open to the water below, characterised in that the dock further comprises:

- a support bracket attachable to the interior edges of the arms and adapted to resist a force urging said arms apart; and
- an arrangement of rollers upstanding from the dock and adapted to support the underside of a boat guided thereon.

Preferably the arms are substantially parallel one another so as to define a strip of open water between them into which the keel of sailboat can fit. The support bracket is preferably U-shaped and/or made of steel.

The floating dock ideally includes a winch, preferably an A-frame winch, suitable for hauling a sailboat onto the dock.

In a preferred embodiment, the deck area and/or the arms comprise a plurality of sub-unit floating dock elements, each dock element being connectable to adjacent dock elements. Any suitable floating subunit dock elements may be employed, not necessarily the multidirectional dock elements of the above-mentioned prior art patents.

Each dock element is preferably provided with one or more horizontally oriented tabs with an aperture therethrough, to enable connection of each dock element to adjacent dock elements. The uniform nature of the dock elements means that a floating dock of any desired size and configuration can be created. The horizontally oriented tabs (which, in use, lie generally parallel the surface of the water) can also be used to mount the support bracket and/or roller assemblies as set out in further detail below.

Preferably, each corner of each dock element is provided with one of said tabs.

Regardless of whether a plurality of sub-unit dock elements is used to construct the dock, the interior edges of the arms, bounding the open area, are provided with a plurality of horizontally oriented tabs projecting into said open area, each tab having an aperture therethrough.

Preferably, the support bracket is attachable to said arms by way of a plurality of downwardly depending pins which are locatable in the apertures of said tabs.

The arrangement of rollers on the floating dock preferably comprises a plurality of roller assemblies, each roller assembly comprising:

- a roller support having a lower end attachable to said deck or one of said arms and an upper end adapted to support a roller; and
- one or more rollers supported on said roller support.

Preferably, each roller assembly further comprises a roller holder comprising an upstanding holder attachable to the deck or one of the arms and said roller support having a lower end of complementary shape to said holder and adapted to fit therewith. The roller holder and the roller support are preferably of non-circular cross-section, for example generally square cross-section.

Various configurations of rollers are envisaged and may be used in combination in a single floating dock. The rollers may include: a keel roller of generally cylindrical shape, a double roller comprising two rollers, one on each end of an axle and/or a quad roller comprising four rollers, one on each end of each of two axles connected by a cross bar.

Preferably, each roller assembly is attachable to said dock by way of a downwardly depending pin which is locatable in the aperture of one of said tabs.

Further preferably, the roller support is slidable in said roller holder in order to adjust the height of the roller assembly. Alternatively said roller assembly further comprises one or more spacers enabling height adjustment of the roller assembly. This allows for easy adaptation of the roller arrangement on the floating dock to accommodate different models of boats.

In a preferred embodiment, the arrangement of rollers on the dock is such that it mimics the pattern of rollers on a road trailer for a known boat type.

The dock preferably further includes one or more docking arms each comprising an elongate rod having a downwardly depending pin which is locatable in the aperture of one of said tabs.

Further features are described in the appended claims.

BRIEF DESCRIPTION OF THE DRAWINGS

Embodiments of the invention are further described hereinafter by way of example with reference to the accompanying drawings, in which.

DETAILED DESCRIPTION

Figure 1:
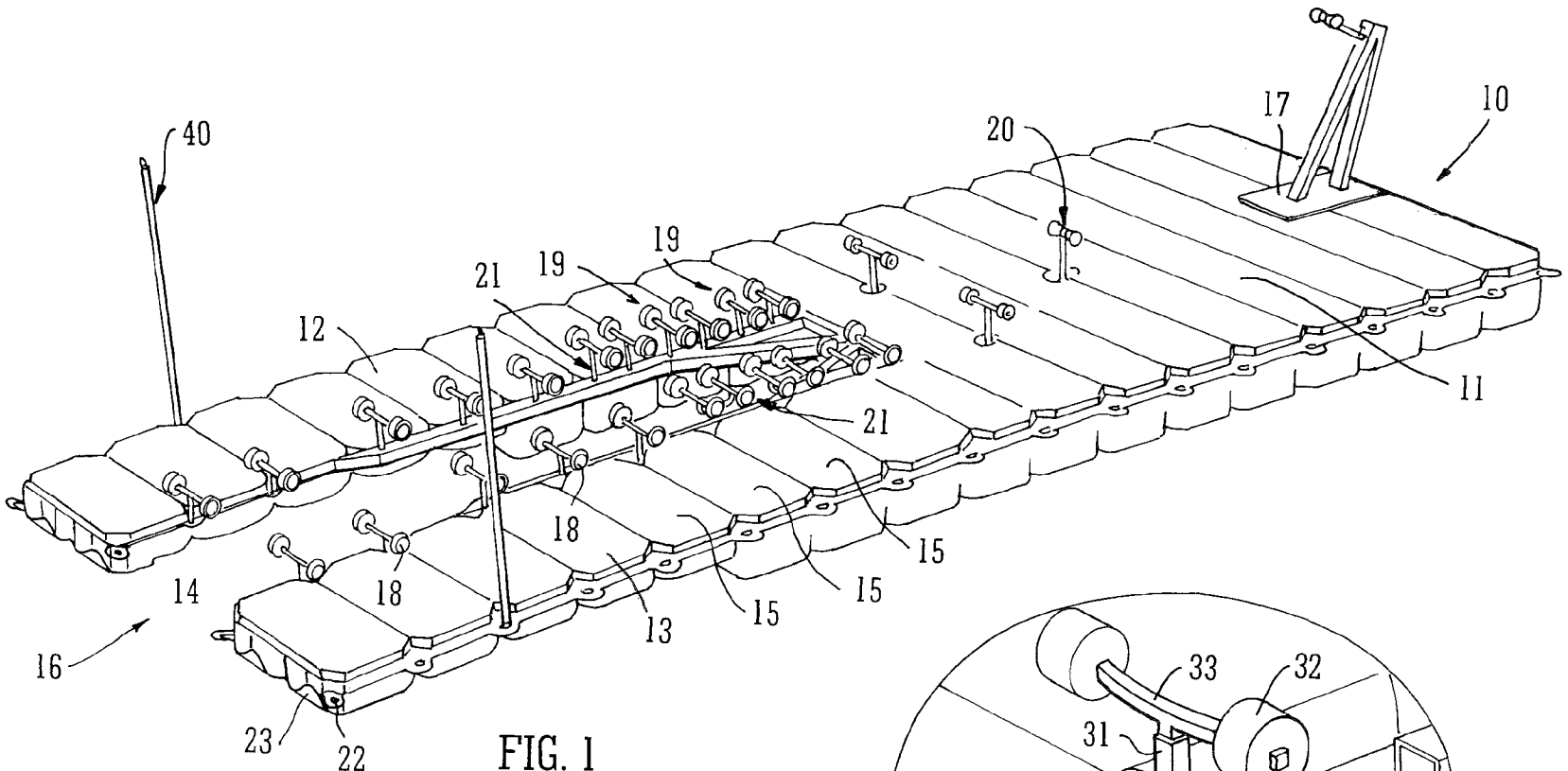
FIG. 1 is a perspective view of a floating dock embodying the invention.

Referring to FIG. 1, a floating dock 10 has a deck area 11 and two generally parallel arms 12, 13 extending therefrom. The arms 12, 13 have an open area 14 between them which is open to the water below. The whole dock 10 is made up from a plurality of individual sub-unit dock elements 15 of known type which are locked together to form a dock of desired size and shape. The dock elements 15 at the entry end 16 of the arms are typically shallower in depth than those which make up the deck area to facilitate a sailboat entering the floating dock from the water.

Whereas in a conventional floating dock (for powered boats, jet skis etc) the boat can propel itself up onto the dock, this is not possible with a sailboat. An A-frame winch 17 is provided at the deck end of the dock to haul the sailboat out of the water and onto the dock.

Furthermore, a sailboat has a depending keel which must be protected from damage and it is therefore necessary to ensure that the underside of the sailboat is properly supported throughout the docking process. An arrangement of rollers is provided which has the dual purpose of, firstly, guiding the sailboat when it is being winched onto or pushed off the dock and, secondly, to support the sailboat on the dock once the docking process is complete.

Different models of sailboats require a different arrangement of rollers to properly support them. The arrangement of rollers in the present invention, described in more detail below, enables easy adjustment of the position and/or height of each roller with respect to the dock so as to set up the dock for a particular model of sailboat. This is achieved by having different types of height-adjustable roller assembly available, which can be attached to the dock by way of the already-present means for attaching the individual dock elements together and/or by attachment to a support bracket.

Figure 1A:
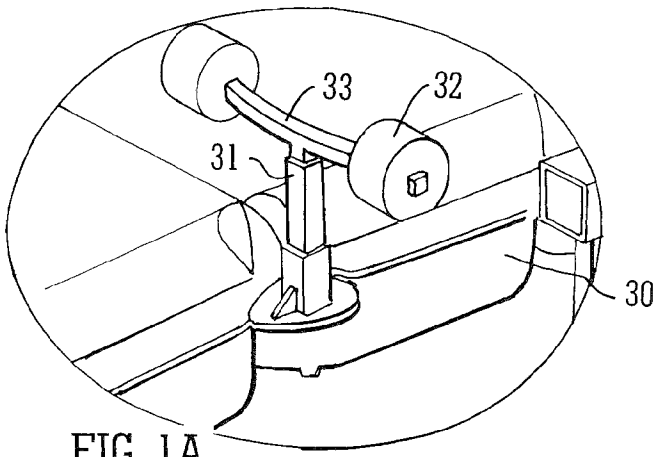
FIG. 1A, drawn to a larger scale, shows detail of a roller assembly.
Figure 5:
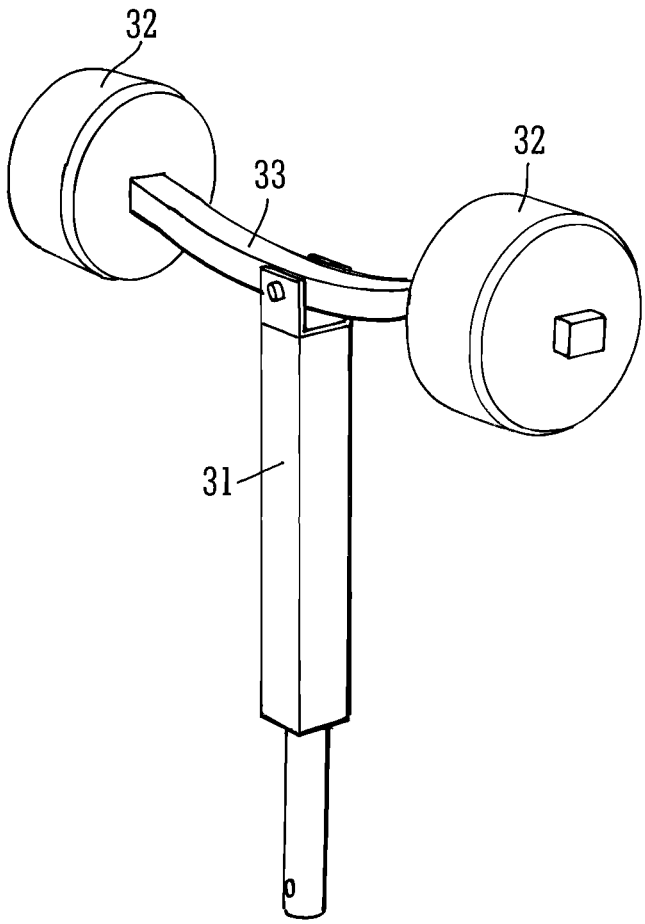
FIG. 5 is a perspective view of a double roller.

In the illustrated embodiment, at the entry end 16 of the dock is an arrangement of double rollers 18 (see FIGS. 1, 1A and 5). Near the interface of the arms 12, 13 and the deck area 11 is an arrangement of quad rollers 19 (see FIGS. 1 and 6). Two further double rollers 18 are provided on the deck area to guide the bow of the sailboat onto a keel roller 20. The bow of the sailboat may be further supported by a raised platform between the keel roller and the winch, preferably constructed from additional dock elements 15 (not illustrated).

Figure 2A:
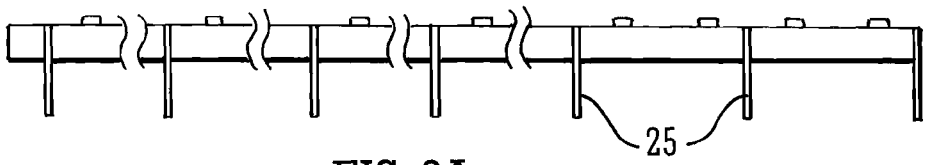
FIG. 2A is a side view of a support bracket.
Figure 2B:
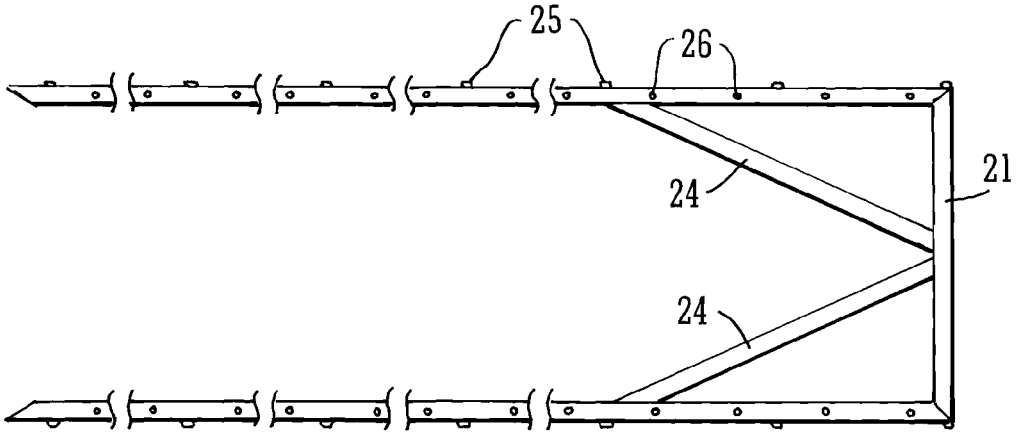
FIG. 2B is a top view of the support bracket of FIG. 2A.
Figure 2C:
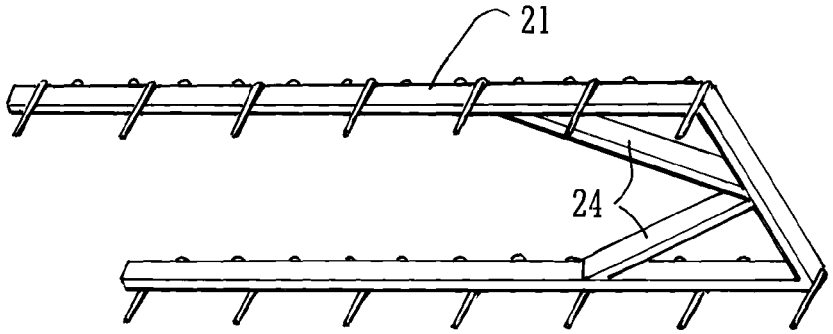
FIG. 2C is a perspective view, viewed from underneath, of the support bracket of FIG. 2A.

In order to strengthen the dock and, in particular, to resist the force urging arms 12, 13 apart when a sailboat is being docked, there is provided a support bracket 21, shown in more detail in FIGS. 2A-2C. The support bracket 21 is preferably made from steel box section and has a generally U-shaped configuration, open to the entry end of the dock. The deck end of the support bracket has braces 24 for additional strength.

Each of the subunit dock elements 15 has, at each corner, a horizontally orientated tab 22 with an aperture 23 therethrough. These tabs are used to connect the dock elements 15 together by placing fixings through the overlapping apertures of adjacent dock elements. In the present invention, these tabs can also be used to mount the support bracket and/or the roller assemblies.

The arms of the support bracket are provided with a plurality of downwardly depending pins 25 whose spacing coincides with the apertures in the dock element tabs 22 extending along the interior edges of the arms 12, 13. The support bracket 21 can therefore be easily mounted on the interior edges of the arms 12, 13 by dropping the pins 25 through the apertures 23.

The arms of the support bracket are also provided with a plurality of spaced holes 26 on which roller assemblies can be mounted.

Figure 3:
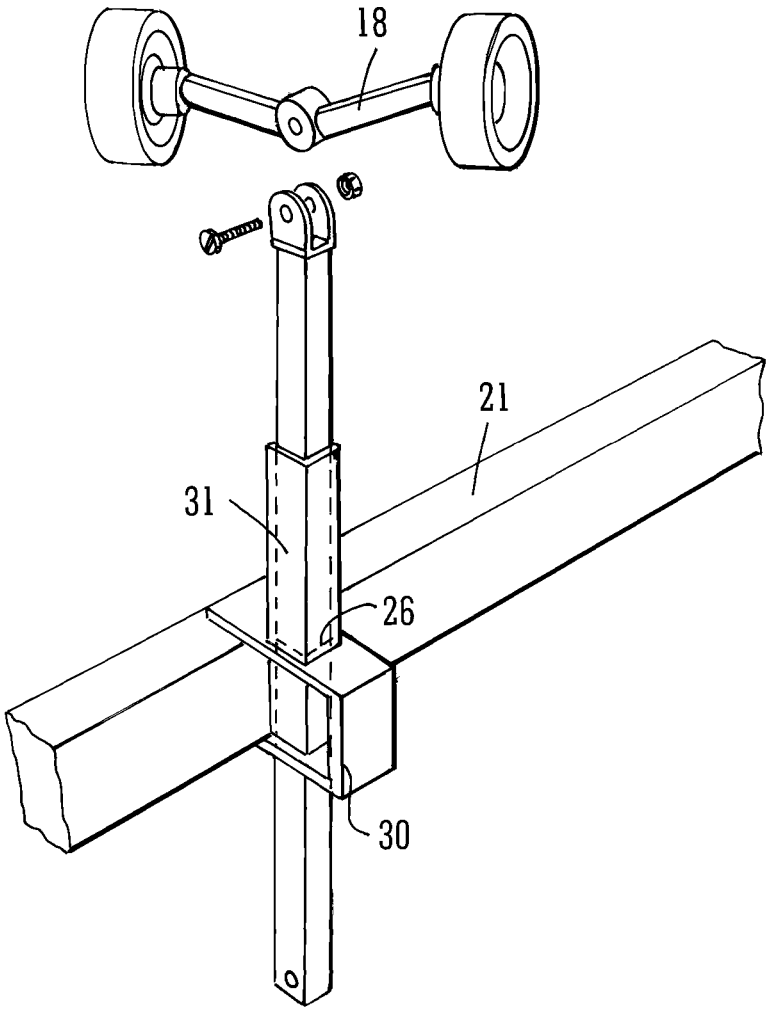
FIG. 3 is a perspective view, partly exploded, of a roller assembly mounted directly on the support bracket.

FIG. 3 shows one embodiment of how a roller assembly can be mounted to the support bracket 21.

With reference to FIG. 1A, the double roller assembly comprises a roller holder 30, a roller support 31 and a two rollers 32 one on each end of an axle 33. The roller holder 30 can either be mounted on the overlapping tabs 22 of adjacent dock elements (as shown in FIG. 1A) or welded directly onto the support bracket 21 (as shown in FIG. 3). Alternatively, a roller assembly without roller holder can have its roller support 31 inserted into one of the support bracket holes 26. The illustrated roller holder 30 has a box section of suitable size to receive a roller support 31, whose lowermost end is also of box section. Other non-circular shapes are envisaged for the roller holder and lowermost end of the roller support.

Figure 4A:
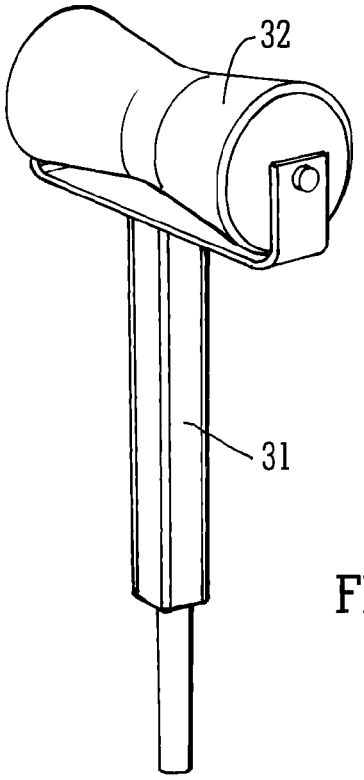
FIG. 4A is a perspective view of a keel roller.
Figure 4B:
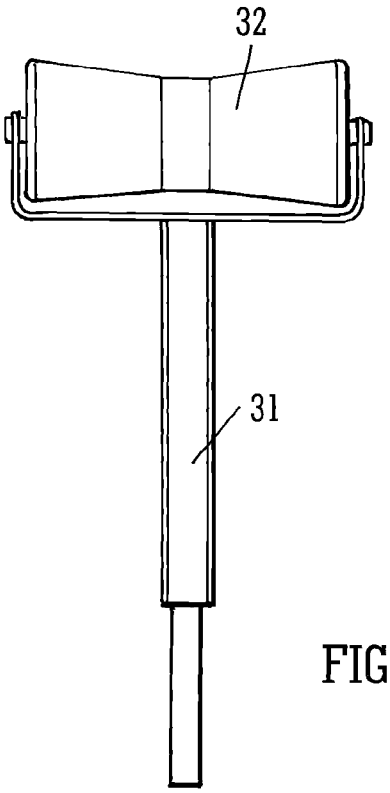
FIG. 4B is a side view of the keel roller of FIG. 4A.
Figure 6:
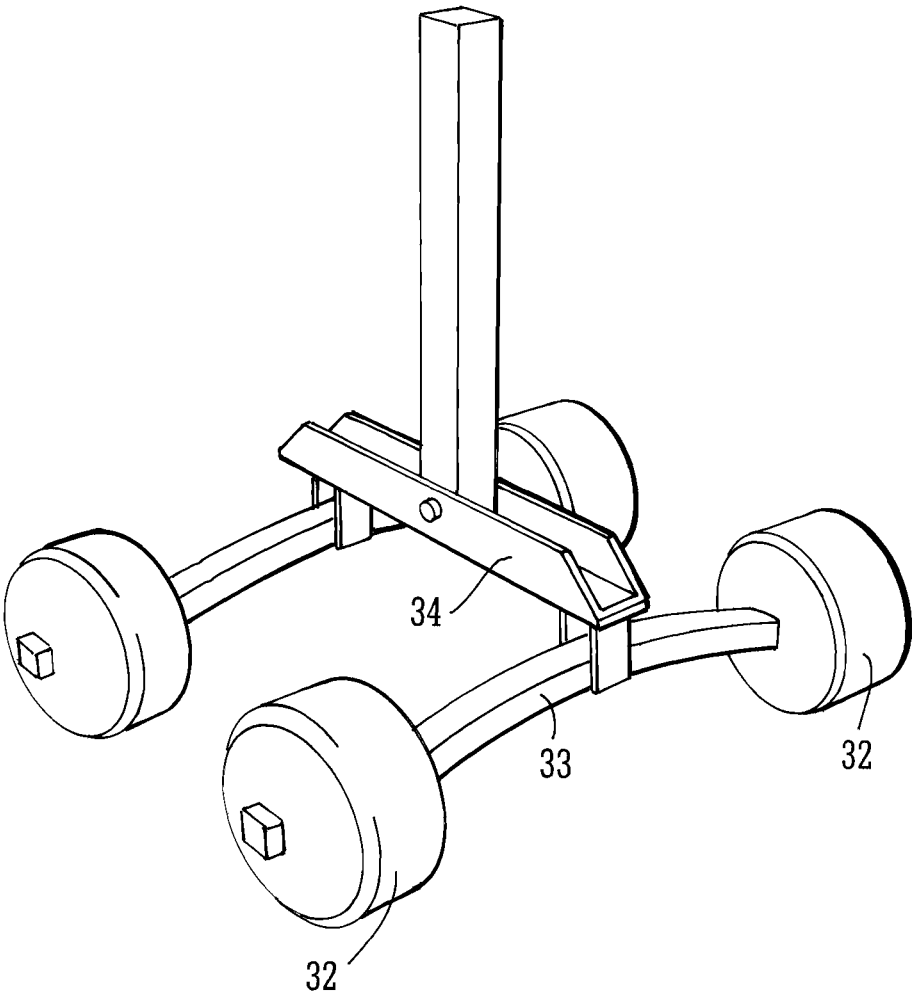
FIG. 6 is a perspective view of a quad roller.
Figure 7A:
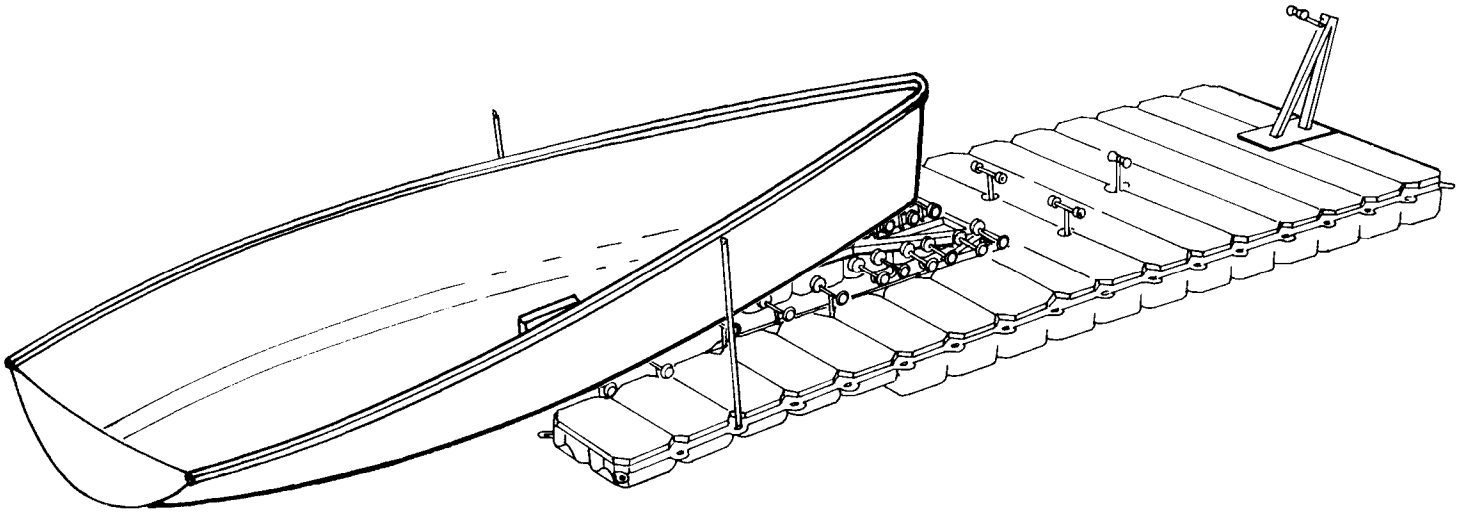
FIG. 7A is a schematic perspective view of a sailboat part-way through being winched onto the floating dock of FIG. 1.
Figure 7B:
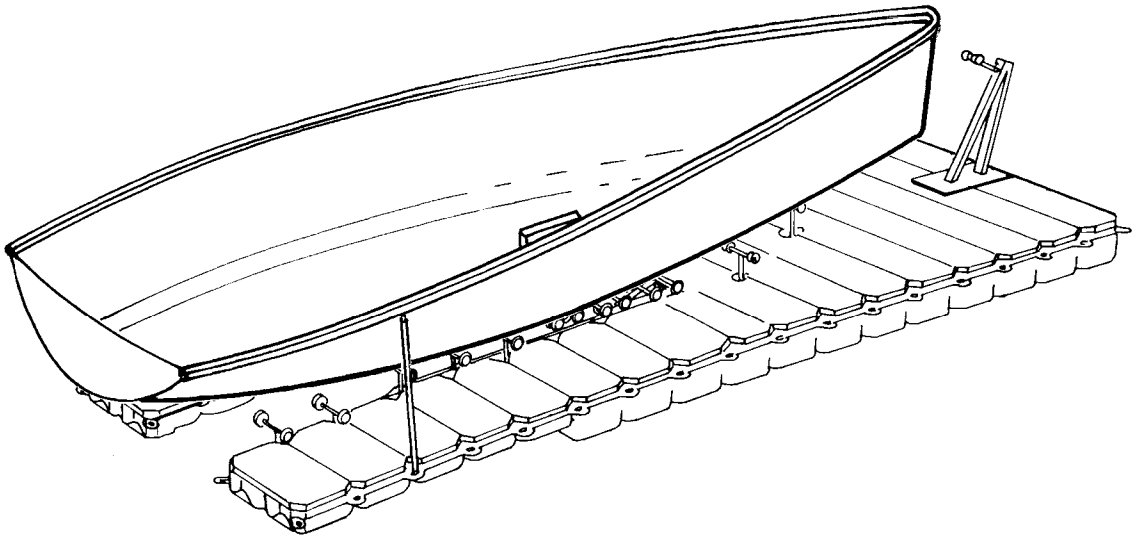
FIG. 7B is a schematic perspective view of a sailboat having been winched onto the floating dock of FIG. 1.

As best shown in FIG. 3, the roller support 31 is height adjustable. Height adjustment can be achieved either by having a telescopic roller support or by the provision of one or more spacers intermediate the roller holder 30 and the roller support 31. Mounted on the roller support 31 are the rollers 32 which, in the case of a double roller, are on either end of an axle 33. A quad roller (as illustrated in FIG. 6) has four rollers 32 mounted on two axles 33 connected by a cross bar 34. A keel roller (as illustrated in FIGS. 4A and 4B has a single roller 32 mounted on the roller support 31.

The pattern in which the roller assemblies are arranged on the dock is selected according to the model of sailboat it is intended to dock. Ideally, the arrangement of rollers mimics the pattern of rollers present on a road trailer for that particular model of sailboat. Double rollers (which have more of a guiding function than a support function) are typically located at the entry end of the dock. Quad rollers (which have more of a support function than a guiding function) are typically located at the deck end of the arms. All of the roller assemblies are height adjustable by virtue of the telescopic roller supports or provision of spacers. The lowermost end of the roller support may extend downwardly beyond the roller holder, or a depending pin may be provided on the roller support which can locate in the tab aperture 23 or the hole 26 in the support bracket.

Each of the individual dock elements 15 from which the dock is constructed has tabs 22 at its corners, meaning that roller assemblies can potentially be placed anywhere on the dock. Roller assemblies placed on the support bracket at the interior edges of the arms 12, 13 have the additional strength provided by the support bracket itself. Different support brackets 12 (with different patterns of holes 26 therein) can be provided for different models of sailboats.

In use, in order to dock a sailboat on the floating dock, the sailboat approaches the entry end of the dock. The winch 17 is connected to the bow of the sailboat. The winch can be wound manually or operated automatically to haul the sailboat into the entry end of the dock wherein the bow rises onto the double rollers at the entry end of the arms 12, 13. Continued winching pulls the sailboat onto the rollers, with the keel located in the open area 14. As the bow approaches the deck area 11, it is supported by roller on the deck area until the bow comes to rest on the keel roller 20. Docking arms 40 (shown in FIG. 1) provide lateral support for the sailboat. These docking arms can be located in any of the tab apertures 23.

When it is desired to launch the sailboat from the dock, it can simply be pushed back towards the entry end 16, guided by the rollers, in the reverse of the docking operation.

The floating dock of the present invention thus provides a convenient and relatively low cost means for docking a sailboat which minimises the risk of damage to the keel. The dock is easily configurable for different models of sailboat.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

The word "floating" as applied to a floating dock or dock element is used for consistency with the prior art and simply means "floatable" i.e. that the dock or dock element is able to float on water. The word includes within its scope floatable elements regardless of whether they are currently in or out of the water.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A floating dock suitable for docking sailboats comprising a floating deck area and two floating arms extending therefrom, the arms having interior edges adjacent an open area therebetween which, in use, is open to the water below, the interior edges of said arms being provided with a plurality of horizontally oriented tabs projecting into said open area, each tab having an aperture therethrough, the dock further comprising:

a support bracket attachable to the interior edges of the arms and adapted to resist a force urging said arms apart, wherein the support bracket is attachable to said arms by way of a plurality of downwardly depending pins which are locatable in the apertures of said tabs; and an arrangement of rollers upstanding from the dock and adapted to support the underside of a boat guided thereon.

2. The floating dock of claim 1 wherein said arms are substantially parallel to one another.

3. The floating dock of claim 1 further comprising a winch suitable for hauling a sailboat onto the dock.

4. The floating dock of claim 1 wherein said support bracket is substantially U-shaped.

5. The floating dock of claim 1 wherein said support bracket comprises steel.

6. The floating dock of claim 1 wherein said deck area and/or said arms comprise a plurality of sub-unit floating dock elements, each dock element being connectable to adjacent dock elements.

7. The floating dock of claim 6 wherein each dock element is provided with one or more horizontally oriented tabs with an aperture therethrough to enable connection of each dock element to adjacent dock elements.

8. The floating dock of claim 7 wherein each corner of each dock element is provided with one of said tabs.

9. The floating dock of claim 1 wherein the arrangement of rollers comprises a plurality of roller assemblies, each roller assembly comprising: a roller support having a lower end attachable to said deck or one of said arms and an upper end adapted to support a roller; and one or more rollers supported on said roller support.

10. The floating dock of claim 9 wherein each roller assembly further comprises:

a roller holder comprising an upstanding holder attachable to said deck or one of said arms;

said roller support having a lower end of complementary shape to said holder and adapted to fit therewith.

11. The floating dock of claim 10 wherein said roller holder and said roller support are of non-circular cross-section.

12. The floating dock of claim 9 wherein one or more of said rollers is a keel roller of generally cylindrical shape.

13. The floating dock of claim 9 wherein one or more of said rollers is a double roller comprising two rollers, one on each end of an axle.

14. The floating dock of claim 9 wherein one or more of said rollers is a quad roller comprising four rollers, one on each end of each of two axles connected by a cross bar.

15. The floating dock of claim 10 wherein said roller support is slidable in said roller holder in order to adjust the height of the roller assembly.

16. The floating dock of claim 9 wherein said roller assembly further comprises one or more spacers enabling height adjustment of the roller assembly.

17. The floating dock of claim 11, wherein said roller holder and said roller support are of generally square cross-section.

18. A floating dock suitable for docking sailboats comprising a floating deck area and two floating arms extending therefrom, the arms having interior edges adjacent an open area therebetween which, in use, is open to the water below, the interior edges of said arms being provided with a plurality of horizontally oriented tabs projecting into said open area, each tab having an aperture therethrough, the dock further comprising:

a support bracket attachable to the interior edges of the arms and adapted to resist a force urging said arms apart, wherein the support bracket is attachable to said arms by way of a plurality of downwardly depending pins which are locatable in the apertures of said tabs; and an arrangement of rollers upstanding from the dock and adapted to support the underside of a boat guided thereon, wherein the arrangement of rollers comprises a plurality of roller assemblies and each said roller assembly is attachable to said dock by way of a downwardly depending pin which is locatable in the aperture of one of said tabs.

19. A floating dock suitable for docking sailboats comprising a floating deck area and two floating arms extending therefrom, the arms having interior edges adjacent an open area therebetween which, in use, is open to the water below, the interior edges of said arms being provided with a plurality of horizontally oriented tabs projecting into said open area, each tab having an aperture therethrough, the dock further comprising:

a support bracket attachable to the interior edges of the arms and adapted to resist a force urging said arms apart, wherein the support bracket is attachable to said arms by way of a plurality of downwardly depending pins which are locatable in the apertures of said tabs; and an arrangement of rollers upstanding from the dock and adapted to support the underside of a boat guided thereon, and further including one or more docking arms each comprising an elongate rod having a downwardly depending pin which is locatable in the aperture of one of said tabs.

* * * * *